US009799181B2

(12) United States Patent
Cushwa, Jr. et al.

(10) Patent No.: US 9,799,181 B2
(45) Date of Patent: Oct. 24, 2017

(54) BARRICADE ALERT SYSTEM

(71) Applicant: National School Control Systems, LLC, Hudson, OH (US)

(72) Inventors: William W. Cushwa, Jr., Hudson, OH (US); David A. Soulsby, Silver Lake, OH (US)

( * ) Notice: Subject to any disclaimer, the term of this patent is extended or adjusted under 35 U.S.C. 154(b) by 0 days.

(21) Appl. No.: 15/083,180

(22) Filed: Mar. 28, 2016

(65) Prior Publication Data

US 2016/0284178 A1 Sep. 29, 2016

Related U.S. Application Data

(60) Provisional application No. 62/139,301, filed on Mar. 27, 2015.

(51) Int. Cl.
*G08B 13/08* (2006.01)

(52) U.S. Cl.
CPC ..... *G08B 13/08* (2013.01)

(58) Field of Classification Search
CPC ..... G08B 13/00; G08B 13/02; G08B 13/08; G08B 13/1427; G08B 13/1436; E05C 19/182; E06B 9/02; G06K 19/0723
USPC ..... 340/539.13, 539.17, 539.23, 541, 545.1, 340/545.3, 545.6, 545.7, 572.1, 572.3, 340/572.4; 292/288, 289, 295, 296, 342, 292/343
See application file for complete search history.

(56) References Cited

U.S. PATENT DOCUMENTS 5,199,759 A * 4/1993 Anderson ..... E05C 19/18 292/288
6,378,917 B1 * 4/2002 Jones ..... E05C 19/184 16/82
7,952,476 B1 * 5/2011 Causey ..... G08B 25/002 340/506
2016/0186470 A1 * 6/2016 Finley ..... E05C 19/18 292/339

* cited by examiner

*Primary Examiner* — Hung T Nguyen
(74) *Attorney, Agent, or Firm* — Medley, Behrens & Lewis, LLC

(57) ABSTRACT

A door barricade alert system includes a door barricade device, a sensor, and a communication system. The door barricade device is normally positioned in a stored, non-installed position. The sensor is associated with the door barricade device in the stored, non-installed position. The communication system is associated with the sensor at one end and with a target at the other end. When the door barricade device is in close proximity to the sensor, the sensor is not activated and when the door barricade device is moved from close proximity to the sensor, the sensor sends a signal through the communication system to a target.

18 Claims, 5 Drawing Sheets

BARRICADE ALERT SYSTEM

CROSS-REFERENCE TO RELATED APPLICATION

This application claims priority to U.S. Provisional Application No. 62/139,301, filed Mar. 27, 2015, the disclosure of which is incorporated herein by reference in its entirety.

FIELD

The present invention concerns a barricade alert system that provides rapid notification in the event of an emergency situation.

BACKGROUND

Recent public events have brought to light the safety of students in classrooms, workers in office buildings, worshipers in a church facility, and the like. Schools are presently investigating and implementing techniques for deterring intruders from entering a school and from being able to enter a classroom. Time is the key factor in the development of strategies for dealing with an intruder. While barricade systems are very useful in preventing or deterring intruders from entering schools or classrooms, it is first necessary that the staff be notified that an intruder is present in the building. Not all schools, offices, churches, or other facilities that would benefit from this technology have ready means for communicating this type of information to a front office or to a central system. When intruders enter a facility, it is very important that the facility go into "lock down" mode as soon as possible in order to avoid harm to the occupants of the facility.

Responders can often take 10 or more minutes to respond in an emergency situation. During this time, schools go into "lock down" mode. This initial 8-10 minutes, when police have not yet arrived, can be critical and has spawned an outpouring of ideas on how to effectively barricade classroom doors in order to allow time for police response and to protect the occupants of the classroom. One type of barricade device presently on the market serves as a door barricade that slides under a door to deter or prevent a door from being opened inwardly or outwardly when installed. Another type of device is utilized with doors that have auto-closing mechanisms, where the device slides over the auto-closing mechanism in order to deter opening of the mechanism and, thus, opening of the door. Another type of device engages the doorknob of the door in order to deter opening of the door. Other devices are also known. All of these devices require that someone notify the front office, or other relevant authorities, in the event of an intrusion. If the relevant authorities can be notified more quickly, response time can be reduced.

DETAILED DESCRIPTION

Figure 1:
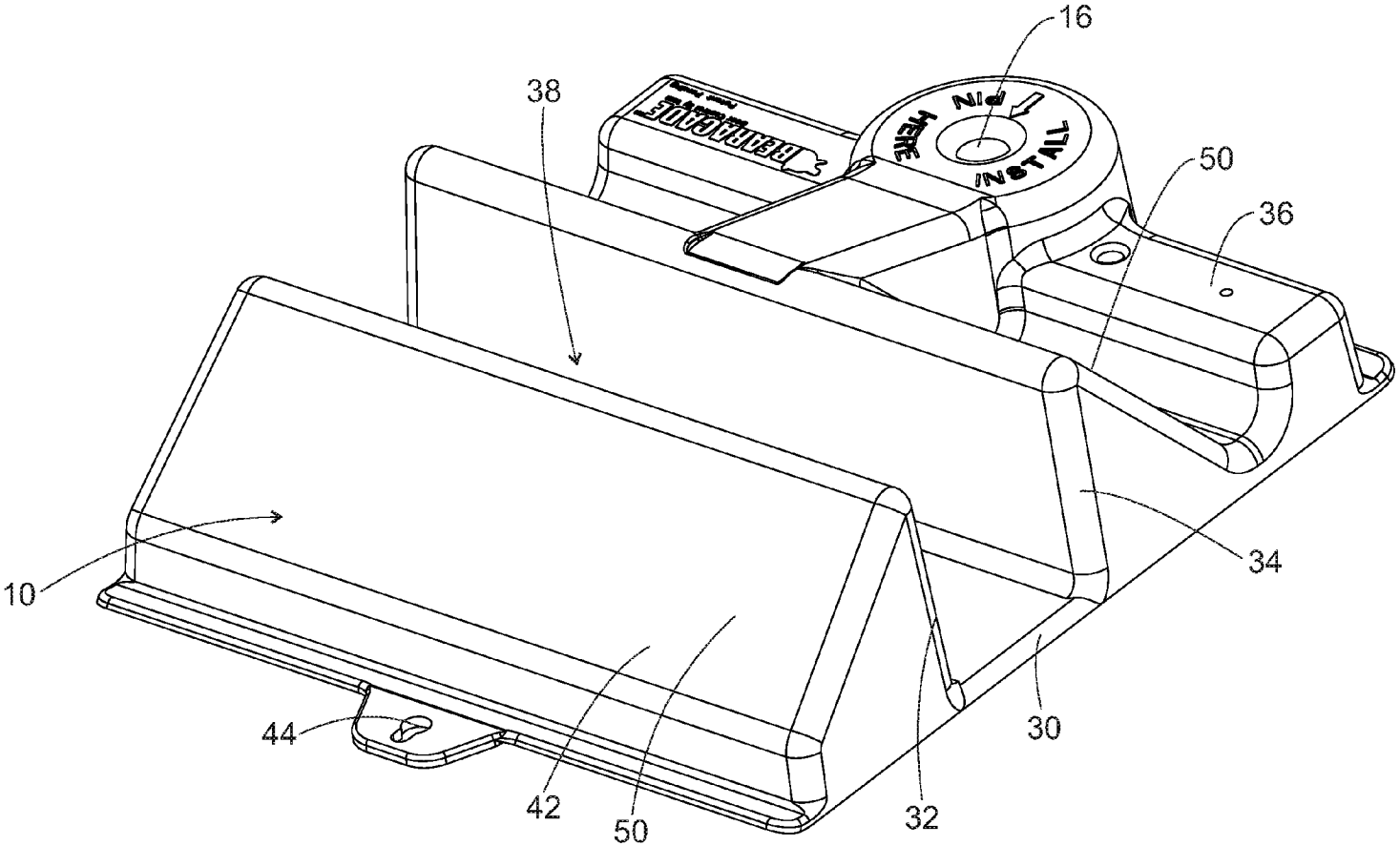
FIG. 1 is a perspective view of one type of barricade device that may be used in barricading a door.

An example barricade device 10 is shown in FIG. 1. The device 10 is described in detail in U.S. patent application Ser. No. 14/107,339, the disclosure of which is incorporated herein by reference in its entirety. The example barricade device 10 provides a barricade that can be used with any type of door 12, such as one that swings inwardly or outwardly, or with a double or a single door 12. The barricade device 10 shown is slid onto a door 12, then the door 12 is closed, and the device 10 is moved into a deployed position, where it can be locked in place with a pin or other mechanism. The barricade device 10 is advantageously coupled to a non-door structure, such as the floor, providing for greater strength since the door frame does not support the force that could be applied to the device 10. Other types of devices are also known and could derive an advantage from the disclosures herein.

Figure 3:
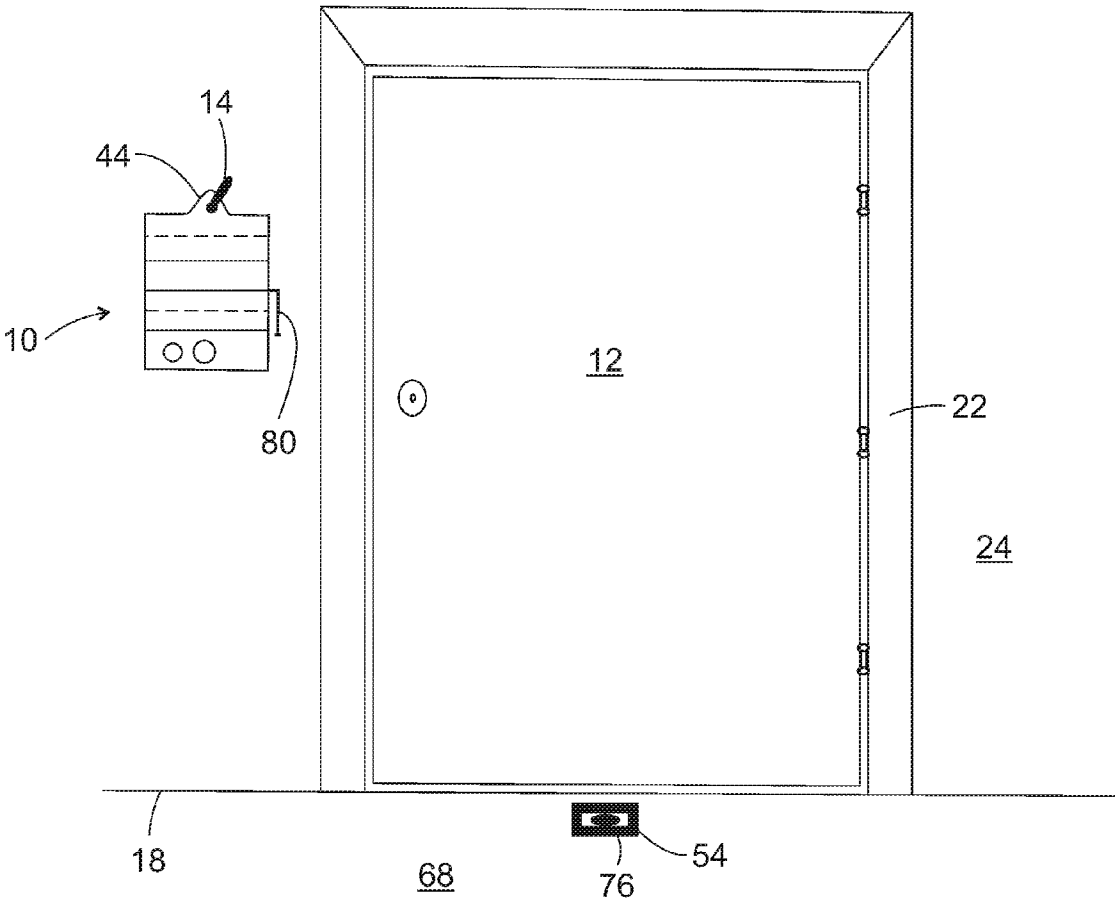
FIG. 3 is a front view of the inside of a room showing the barricade device stored on the wall next to a door.

As shown in FIG. 3, the example barricade device 10 may either be permanently installed or may be temporarily positioned near a door 12 so that, when it is needed, it may be quickly and easily deployed and installed on a door 12 of a room 24 within a building or facility 26, such as a classroom, office building, or home. For example, the example barricade device 10 may be hung on a hook 14 near the door 12, or otherwise stored near the door 12 or on the door 12, so that when it is needed, it can be removed from the hook 14 and positioned under the door 12.

The barricade device 10 is easy to install. The device 10 can be used on any type of door 12, including a classroom door, an office door, a restroom door, a door without a lock, an inwardly swinging door, or an outwardly swinging door, among other types of doors. The example barricade device 10 may be used to secure double doors, such as those that may be encountered in a library, chapel, or conference room setting. The example barricade device 10 can be deployed immediately with simple pre-installation of a receptacle 16 in the floor 18, such as a channel or hole, for receiving a securing member 20, such as a pin. No door frame 22 modifications are necessary.

The example device 10 relies on the floor 18 or another surface for providing strength to the barricade device 10, rather than a door frame 22. Other types of devices, including those that rely on the door frame 22 for support may also derive a benefit from the examples described herein. According to the invention, the barricade device 10 may include a portion that can alert authorities that a room 24 is secured. This may allow authorities to more quickly search a building 26 for an intruder and to divert resources to locations where an active intruder may be. This may further help to reduce response time to an appropriate portion of a building 26.

Figure 2:
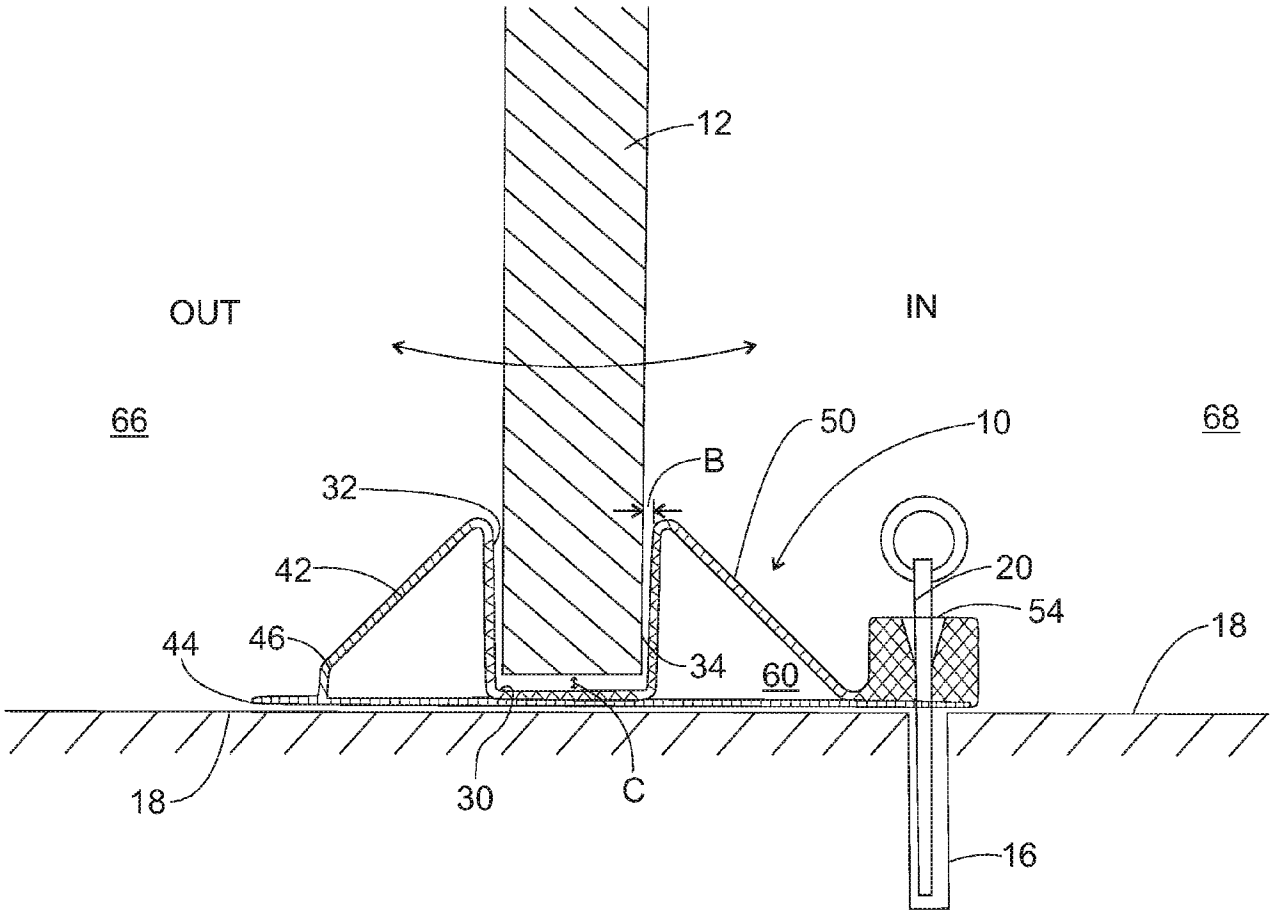
FIG. 2 is a cross-sectional view of an example barricade device installed on a door.

FIG. 2 shows the barricade device 10 installed under a door 12. The door 12 in this example can either swing inwardly or outwardly and the barricade device 10, once coupled to the floor 18, will deter movement of the door 12 either inwardly or outwardly. The barricade device 10 includes first and second upwardly extending members 32, 34. The door 12 seats in a recess 38 that is defined between the first and second upwardly extending members 32, 34. The barricade device includes a tab 44 and a fortified end portion 36 that accepts a pin. The tab 44 is positioned on the outer side 66 of the door and the fortified end portion 36 is positioned on the inner side 68 of the door during use. The first and second upwardly extending members 32, 34 abut the inner and outer side 68, 66 of the door 12. Clearance B is provided between the door 12 and the upwardly extending members 32, 34. Clearance C is provided between the base 30 and the bottom of the door 12. An opening 76 is defined in the floor 18 and a pin 20 extends through the channel 54 defined in the fortified portion 36 and into the opening 76. The pin 20 helps to hold the barricade device 10 in position in order to barricade the door 12 and should be of sufficient strength to withstand attempts to break down the door 12. As is evident the angled surfaces 42, 50 extend outwardly and upwardly so that they are visible to a user.

FIG. 3 shows the barricade device 10 being stored on a hook 14 on a wall that is next to the door 12 inside a room 24. The door 12 shown reflects the inside 68 of a door 12, and the outside 66 of the door 12 is on the opposite side, which is not shown. The device 10 may be stored at other locations, as long as it is easily accessible in a time of need. A hook 14 may be used to store the barricade device 10. Alternatively, clamps (not shown) could be used to couple the barricade device 10 directly to the door 12 or wall (not shown). Other installation techniques and positions may be used.

Figure 4:
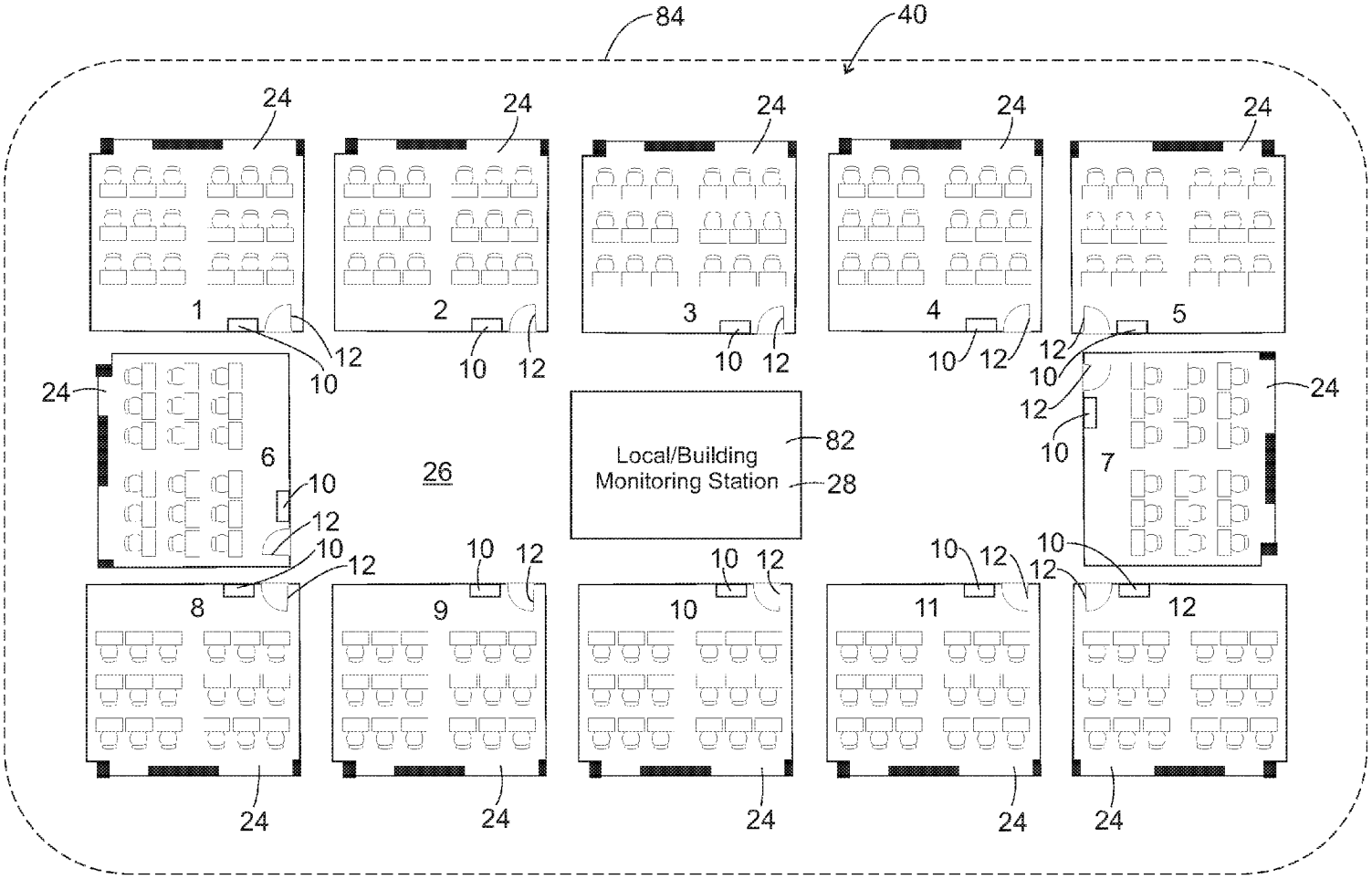
FIG. 4 is a schematic showing an example of a building monitoring station for the example alert system.

FIG. 4 shows a local building monitoring system 40. Each room 24 in the building 26 has a barricade device 10 and a sensor 80 coupled to the barricade device 10. All the rooms 24 communicate with a centrally disposed monitoring station 82. Communication between the sensors 80 and the monitoring station 82 may be wireless, cellular, or wired, and may be aided by a computer, a computer network, computer software, and any other known devices that are used in monitoring situations, as known by those of skill in the art.

Figure 5:
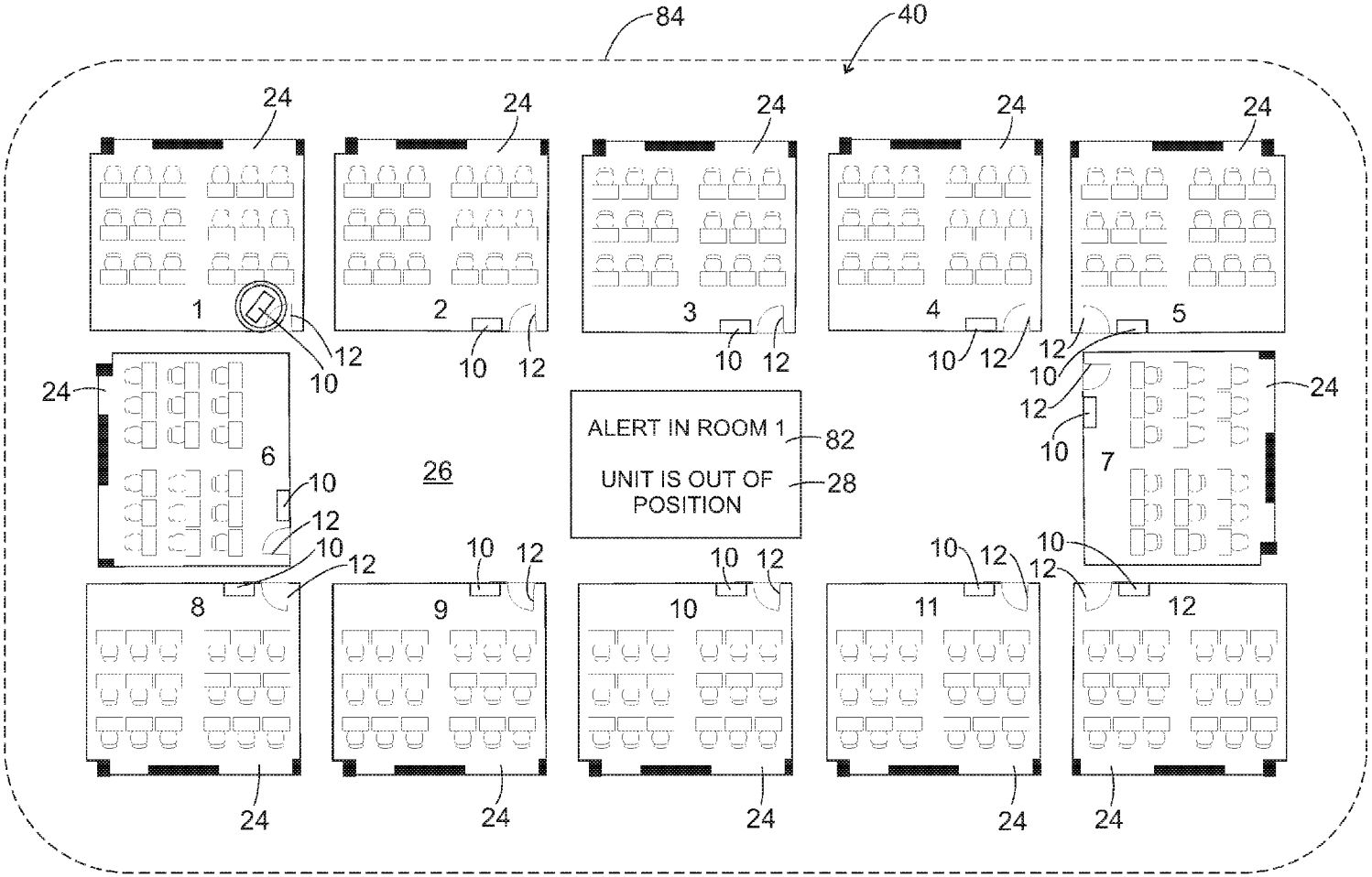
FIG. 5 is a schematic showing an example of the operation of the alert system.

FIG. 5 shows a local building monitoring system 40 when a barricade device 10 has been moved from its storage location. The movement of the barricade device 10 causes an alert to be signaled through a communication system 84 to the monitoring station 82. The monitoring system 40 can recognize the location of the alert as well as signal a message that the barricade device 10 is out of place. In addition, although not shown, the movement of the barricade device 10 can signal to other rooms 24 that they should deploy their barricade devices 10. The alert may be wireless, cellular based, or hardwired to a local computer.

In addition to signaling that a barricade device 10 is out of place, the system 40 can signal to a front office and/or to other rooms 24 within a facility 26 that an intruder is in the building and that they should deploy their barricade devices 10. In one example, removal of the barricade device 10 from the storage location can signal to a target, such as a front office 28, that the device 10 has been removed. This can prompt the office 28 to contact the room 24 in question. If the room 24 does not respond or responds to confirm that there is an intruder, the front office 28 can signal the remaining rooms 24 in the building 26 concerning the situation. Multiple different scenarios can be envisioned that can be tied to removal of the barricade device 10 from its storage position.

In addition, the system 40 can facilitate communication from the building 26 to local law enforcement. This can be automatic or manual. When automatic, the system 40 provides rapid or nearly immediate notification to the relevant targets of the message, whether that be the school administration, a teacher, the office manager, the police department, campus security, or the like. While the alert system 40 is discussed in the context of a barricade device 10, the same could be used for fire extinguishers, electronics, or other devices that can alert to a target that some type of action has been taken.

The example system 40 may be used with any type of barricade device 10 that is normally stored in an uninstalled position. The alert system 40 is normally silent and inactive. A sensor 80 is associated with the barricade device 10 in the stored position. The sensor 80 may be coupled to a wall, a bookcase, or any other surface adjacent or in proximity to where the barricade device 10 is normally stored. A contact, RFID chip and reader, or other device may be associated with the barricade device 10 so that when it is removed from the storage location, an alert is sent through the communication system 84 to a target 28. The sensor 80 can be a proximity sensor so that if the barricade device 10 is removed from the sensor 80, the sensor 80 will signal an alert to the communication system 84. The sensor 80 may contact a part of the barricade device 10. Alternatively, the sensor 80 can be a proximity sensor so that if the barricade device 10 is removed from an area surrounding the sensor 80 (such as, for example, 1 foot, 2 feet, or some other range), then the sensor 80 will send a signal through the communication system 84.

The communication system 84 may communicate with any number of different targets. Examples of targets include the front office 28, an administrator or the administration, local or state law enforcement, the fire department, or others.

The alert signal sent from the sensor 80 may create an audible sound, a visual warning, or may be silent. The alert may be a text message, an email, or an automated voice response to any number of different people.

The alert system described herein can be used with any type of safety device that is designed to deter intruder's entry into a building 26 or a room 24. The simple process of removal of the barricade device 10 would be the only motion necessary to activate the alert. No other motion or process would be necessary. For example, it would no longer be necessary for a teacher to have to notify the front office 28 of the presence of an intruder. The alert would be immediate and would not be delayed for confirmation.

The system 40 could be placed into "drill mode" so that the barricade device 10 could be removed and used for training without eliciting full emergency response. The resulting communication could alert the target 28 to the date, time, and location of the moved device 10 whether in drill or regular alert mode. The technology would link each safety device 10 to a specific room 24 to provide immediate notification of the location to immediately alert one or more entities to an emergency situation.

The system 40 could act simply as a panic alarm should the traditional aspect of the barricade device 10 not be deployed, be unable to be deployed (circumstances make it impractical or unsafe to deploy), or not desired to be deployed (assailant may already be in the room 24). The system 40 could be contained to one part of one building 26 (one law office 24 in a larger building 26 of offices), one building 26, or an entire campus of buildings.

The sensors 80 could be mounted in pairs within a room 24. One side of the sensor 80 is affixed to the barricade device 10. The companion piece of sensor 80 is permanently affixed to the prescribed storage location (hanging on a wall, nested within a wall bracket, inside a secure box, etc.). The sensor 80 could be contact-related or initiated due to a change in proximity (di stance between barricade device 10 and the storage location). The proximity alert could be more helpful to avoid false alarms that might be caused by imprecise contact between the two elements. A proximity change may be selected, such as 6, 12, or 18 inches. Alternatively, the proximity limit may be limited to a distance that is required in order to deploy the barricade device 10.

The system 40 could generate an alert that could display via a smartphone, tablet, IP-connected device, traditional land line phone service, or other systems. The sensors 80 could be wireless so as to allow complete and unrestrained deployment of the traditional barricade device 10. Alternatively, the sensors 80 could be hard wired to the storage location, although the cost of hard-wiring such a solution might defeat the cost-effectiveness of the offering in some cases.

A software package could be employed to manage and correctly link each barricade device 10 to a specific location. The software package could overlay the placement of barricade devices 10 onto a floor plan to help guide administrators and authorities to the location of activation or identify the locations where a device(s) was not activated. The alert could be accompanied by a light mounted outside each room 24 to further alert administrators and authorities, or inside each room 24 to alert the occupants to deploy the barricade device 10. The alert system can be tied to a software program that is associated with a computer or tablet that shows a map displaying where devices 10 have been deployed and where they have not in order to allow law enforcement to focus on specific areas of a building 26.

Removal of a barricade unit 10 from its storage location could provide an immediate alert for a building 26 to go into lockdown without any additional human notification or actual verbal notification. For instance, removal of the device 10 could quickly generate an automated "LOCKDOWN! LOCKDOWN! This is not a drill," announcement over a public address system or via a computerized network message.

As known by those of skill in the art, adequate battery life if required in order to avoid false alarms. The alert system 40 could be managed without the use of a monitoring center. It could be linked to an existing alarm monitoring operation, i.e., the Alarm Company. The concern remains that time is of the essence and adding a layer of monitoring and eventual notification adds undue delays. The "human factor" of delay is an element that is removed by the instant system 40.

The system 40 is a panic alert and security alarm in that monitors the removal of or separation of two parts meant to alert administration and safety forces of the separation or removal from a set location. The alert is not necessarily an audible alert, although it could be, which might be confused as a tornado siren or fire alarm. If an audible alert is used, it should have a sound that is different from other alarms. The alert could be to a central panel 28 within a building and simultaneously to local law enforcement.

A first example alert system includes a door barricade device, a sensor, and a communication system. The door barricade device is normally positioned in a stored, non-installed position. The sensor is associated with the door barricade device in the stored, non-installed position. The communication system is associated with the sensor at one end and with a target at the other end. When the door barricade device is in close proximity to the sensor, the sensor is not activated and when the door barricade device is moved from close proximity to the sensor, the sensor sends a signal through the communication system to a target.

The door barricade device may be in close proximity when in about 6 inches, 12 inches, or 18 inches. The door barricade device may be in close proximity to the sensor when it is close enough to the sensor that it is not possible to be installed in a deployed position. The door barricade device may be stored in a non-installed position near a door, and the signal that is sent by the sensor via the communication system is silent.

The communication system may be associated with a computer. The communication system may be wireless, cellular, or hard-wired. The communication system may be tied to an audible signal and/or a visual signal. The communication system may include a software program that displays on a display device indicating where within a facility the door barricade device has been deployed and where they have not been deployed. The display device may be a computer display or a tablet.

In another example, an alert system includes a plurality of door barricades, a sensor associated with each said door barricade, and a communication system. The plurality of door barricades is normally stowed in a non-deployed position in separate locations within a facility. The sensor is associated with each said door barricade in the stowed position. The communication system is coupled between the plurality of door barricades and the corresponding sensors for alerting a central office in the event that one or more of the door barricades is removed from the stowed position.

The communication system may include a hard wired or wireless system that is coupled between the sensor and a computer. The alert system may also include a software program associated with the communication system for identifying where one or more of the plurality of door barricades has been removed from the normally stowed position. The sensor may include an RFID chip positioned on each said door barricade and a reader coupled to a fixed location in the vicinity of the stowed position of each said door barricade. The sensor may be a contact. Each barricade device may be positioned in the stowed position by hanging the barricade device on a hook that is coupled to a wall. The sensor may include an RFID reader that is associated with the facility for reading the location of multiple RFID chips within the facility.

In another example, a method for alerting occupants that an intruder has entered a facility includes normally stowing a door barricade device in the vicinity of a door within a room of a facility and removing the door barricade device from the normally stowed position in order to activate a sensor. The sensor sends a signal to a target to indicate that the door barricade device has been removed from its stowed position.

The method may also include issuing a signal to other rooms within the facility that a lockdown has been ordered by one or more of an audible signal, a wireless message, a visual signal, or a telephone message.

While the above discussion is in the context of a classroom, it should be readily understood that the example barricade device 10 may be used with any type of building, including an office building, church, or other building that utilizes doors.

The term "non-door surface" is meant to describe any number of surfaces around a door 12, except for a door frame. This may include the walls and/or floors around a door. To the extent there are other surfaces around a door 10, other than the frame, that are not mentioned, the term "non-door surface" is also meant to encompass these other surfaces.

While the above discussion was in the context of an actual alert situation, the example system 40 can also provide the benefit of notifying the target 28 of tampering with the barricade device 10. For example, if someone removes the device 10 from its storage location, an alarm would be signaled. By knowing that the device 10 has been removed, loss of the device 10 can be avoided.

Various technologies pertaining to alert systems or alarm systems were described herein. For purposes of explanation, numerous specific details are set forth in order to provide a thorough understanding of one or more aspects. It may be evident, however, that such aspect(s) may be practiced without these specific details. In other instances, well-known structures and devices are shown in block diagram form in order to facilitate describing one or more aspects. Further, it is to be understood that functionality that is described as being carried out by certain system components may be performed by multiple components. Similarly, for instance, a component may be configured to perform functionality that is described as being carried out by multiple components.

Moreover, the term "or" is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form.

Further, as used herein, the terms "component" and "system" are intended to encompass computer-readable data storage that is configured with computer-executable instructions that cause certain functionality to be performed when executed by a processor. The computer-executable instructions may include a routine, a function, or the like. It is also to be understood that a component or system may be localized on a single device or distributed across several devices. Further, as used herein, the term "exemplary" is intended to mean serving as an illustration or example of something, and is not intended to indicate a preference.

The term "substantially," if used herein, is a term of estimation.

While various features are presented above, it should be understood that the features may be used singly or in any combination thereof. Further, it should be understood that variations and modifications may occur to those skilled in the art to which the claimed examples pertain. The examples described herein are exemplary. The disclosure may enable those skilled in the art to make and use alternative designs having alternative elements that likewise correspond to the elements recited in the claims. The intended scope may thus include other examples that do not differ or that insubstantially differ from the literal language of the claims. The scope of the disclosure is accordingly defined as set forth in the appended claims.

What is claimed is:

1. A door barricade alert system comprising:

a door barricade device normally positioned in a stored, non-installed position;

a sensor associated with the door barricade device in the stored, non-installed position; and a communication system associated with the sensor at one end and with a target at another end, wherein when the door barricade device is in close proximity to the sensor, the sensor is not activated and when the door barricade device is moved from close proximity to the sensor, the sensor sends a signal through the communication system to the target during an event of an emergency situation.

2. The door barricade alert system of claim 1, wherein close proximity is about 6 inches, 12 inches, or 18 inches.

3. The door barricade alert system of claim 1, wherein the door barricade device is in close proximity to the sensor when it is close enough to the sensor that it is not possible to be installed in a deployed position.

4. The door barricade alert system of claim 1, wherein the door barricade device is stored in a non-installed position near a door, and the signal sent by the sensor via the communication system is silent.

5. The door barricade alert system of claim 1, wherein the communication system is associated with a computer.

6. The door barricade alert system of claim 1, where the communication system is wireless, cellular, or hard-wired.

7. The door barricade alert system of claim 1, wherein the communication system is tied to an audible signal and/or a visual signal.

8. The door barricade alert system of claim 1, wherein the communication system includes a software program that displays on a display device indicating where within a facility the door barricade device has been deployed and where they have not been deployed.

9. The door barricade alert system of claim 8, wherein the display device is a computer display or a tablet.

10. An alert system comprising:

a plurality of door barricades that are normally stowed in a non-deployed position in separate locations within a facility;

a sensor associated with each said door barricade in the stowed position; and a communication system coupled between the plurality of door barricades and the corresponding sensors for alerting a central office during an event of an emergency situation that one or more of the door barricades is removed from the stowed position.

11. The system of claim 10, wherein the communication system comprises a hard wired or wireless system that is coupled between the sensor and a computer.

12. The system of claim 11, further comprising a software program associated with the communication system for identifying where one or more of the plurality of door barricades has been removed from the normally stowed position.

13. The system of claim 10, wherein the sensor includes an RFID chip positioned on each said door barricade and a reader coupled to a fixed location in a vicinity of the stowed position of each said door barricade.

14. The system of claim 10, wherein the sensor is a contact.

15. The system of claim 10, wherein each barricade device is positioned in the stowed position by hanging the barricade device on a hook that is coupled to a wall.

16. The system of claim 10, wherein the sensor includes an RFID reader that is associated with the facility for reading the location of multiple RFID chips within the facility.

17. A method for alerting occupants that an intruder has entered a facility comprising:

normally stowing a door barricade device in a vicinity of a door within a room of a facility;

removing the door barricade device from the normally stowed position in order to activate a sensor; and with the sensor sending a signal to a target to indicate that the door barricade device has been removed from its stowed position during an event of an emergency situation.

18. The method of claim 17, further comprising issuing a signal to other rooms within the facility that a lockdown has been ordered by one or more of an audible signal, a wireless message, a visual signal, or a telephone message.

* * * * *